US005713566A

United States Patent [19]

Coombs et al.

[11] Patent Number: 5,713,566

[45] Date of Patent: Feb. 3, 1998

[54] ALIGNMENT MEANS AND FIXED STAPLER

[75] Inventors: Peter M. Coombs, Tustin, Calif.; Klaus Thogersen, Klampenborg, Denmark

[73] Assignee: Gradco (Japan) Ltd.

[21] Appl. No.: 558,139

[22] Filed: Nov. 13, 1995

[51] Int. Cl.[6] ..... B65H 39/02

[52] U.S. Cl. ..... 270/58.12; 270/58.16; 270/58.17; 271/292; 271/221

[58] Field of Search ..... 270/58.12, 58.16, 270/58.17; 271/292, 293, 294, 221, 241

[56] References Cited

U.S. PATENT DOCUMENTS

| | | | |
|---|---|---|---|
| 3,733,070 | 5/1973 | Obenshain | 271/221 |
| 4,178,119 | 12/1979 | Busch | 271/221 X |
| 4,354,672 | 10/1982 | Kulpa et al. | 271/221 |
| 4,477,218 | 10/1984 | Bean | 271/221 X |
| 4,919,414 | 4/1990 | Marchke et al. | 271/221 X |
| 5,169,134 | 12/1992 | Ishiguro et al. | 270/58.16 |
| 5,349,131 | 9/1994 | Lawrence | 270/53 |

*Primary Examiner*—Hoang Nguyen
*Attorney, Agent, or Firm*—Newton H. Lee, Jr.

[57] ABSTRACT

A moving bin sorter of the type in which the trays are individually and collectively moved vertically relative to a sheet inlet location and opened to provide an enlarged sheet entry space for receiving the sheets, has trays displaced in a manner which controls and allows them to move parallel to each other at all times. Alignment and registration units have steel rule type members oppositely extensible into the enlarged sheet entry space with pads on the ends thereof conforming in shape to the enlarged sheet entry space for aligning the edges of various sizes of sheets and moving sets of sheets laterally of the trays to a stapler and returning the stapled sets towards the center of the trays.

8 Claims, 5 Drawing Sheets

ALIGNMENT MEANS AND FIXED STAPLER

BACKGROUND OF THE INVENTION

The present invention relates to sorters or sheet receivers adapted to receive printed sheets from copiers, printers, or facsimile machines in an array of sheet receiving trays which are vertically spaced, extend generally horizontally at an incline and individually moved vertically relative to a sheet infeed location by cams which provide an increased sheet entry space between trays at which the sheets are carried from the sheet producing machine into the trays, and wherein the trays are relatively close together at other times.

Alignment of the sheets in sets in each tray results from trailing edge alignment at the lower, sheet inlet ends of the trays against a backstop, and alignment means of various types have been used to align the side edges of the sets.

Such sorters have evolved in which the sets of sheets are automatically stapled following alignment.

PRIOR ART

Various examples exist in the prior art which illustrate the ability to align or register sets of sheets in various sorting machines, so that a staple can be driven into an edge or corner of a set of sheets before removal of the stapled set from the sorting machine.

In U.S. Pat. No. 5,443,249 granted Aug. 22, 1995 to Rizzolo et al, a beater moves successive sheets from the position received on the tray or underlying sheets for corner registration in the throat of a stapler which is then activated to staple the set before removal from the tray.

In the prior U.S. Pat. No. 5,253,860 granted Oct. 19, 1993 to Hiroshe et al, there is disclosed an example of a sorting machine involving jogging or aligning means whereby the sheets fed into the enlarged sheet space provided by movement of the trays are displaced by a verticaly extended jogging wire into alignment on the tray, and a gripping or so-called chuck grips the aligned set of sheets to move the set into a stapler located at the corner of the tray so as to apply a staple into the set.

In Lawrence U.S. Pat. No. 5,125,634 granted Jun. 30, 1992, there is an example of a moving tray sorter of the type here involved in which a set of sheets deposited in the enlarged sheet entry space between the trays is gripped by a gripping mechanism and moved in the direction of sheet infeed into the throat of a stapler for automatic stapling and then the stapled set is returned to its original position on the tray.

In Lawrence, U.S. Pat. No. 5,344,131 granted Sep. 6, 1994, there is illustrated a moving bin sorter having a bidirectional aligning mechanism in which alignment members are moved laterally towards one another in unison for jogging the sheets into alignment along their side edges before moving a stapler into a stapling position for stapling the set of sheets in the receiving tray.

The above are examples, only, of many patented so-called in-bin stapling devices in which, in various ways, the side edges of the sheets in the receiving tray are aligned and either moved to a stapler as a set or wherein a stapler is moved into a position for stapling the set.

SUMMARY OF THE INVENTION

The present invention relates to jogging or aligning sheets in a receiving tray utilizing novel aligning means, whereby the sheets are aligned between relatively movable aligning and registration members in the form of elongated flexible members in the nature of a flexible steel rule rewindable on a spool but adapted to be extended the necessary distance for edge engagement with sheets of different sizes, to align the sheets in sets. More specifically the aligned sets are also transferred into the throat of a stationary stapling device located at one corner of the apparatus.

More particularly the aligning devices are incorporated in a moving bin sorter of the type which provides an enlarged sheet entry space in which the sheets are received from a host copier, printer or the like and wherein the enlarged sheet entry space is defined between a pair of adjacent trays which extend substantially in parallel relation, as described in companion application of Coombs, Ser. No. 555,651, filed Nov. 15, 1995. The aligning and registering devices extend only into the enlarged sheet entry space.

The invention has other features and advantages which will become apparent to those skilled in the art from the following detailed description taken together with the accompanying drawings forming a part hereof.

DESCRIPTION OF THE PREFERRED EMBODIMENT

Figure 1:
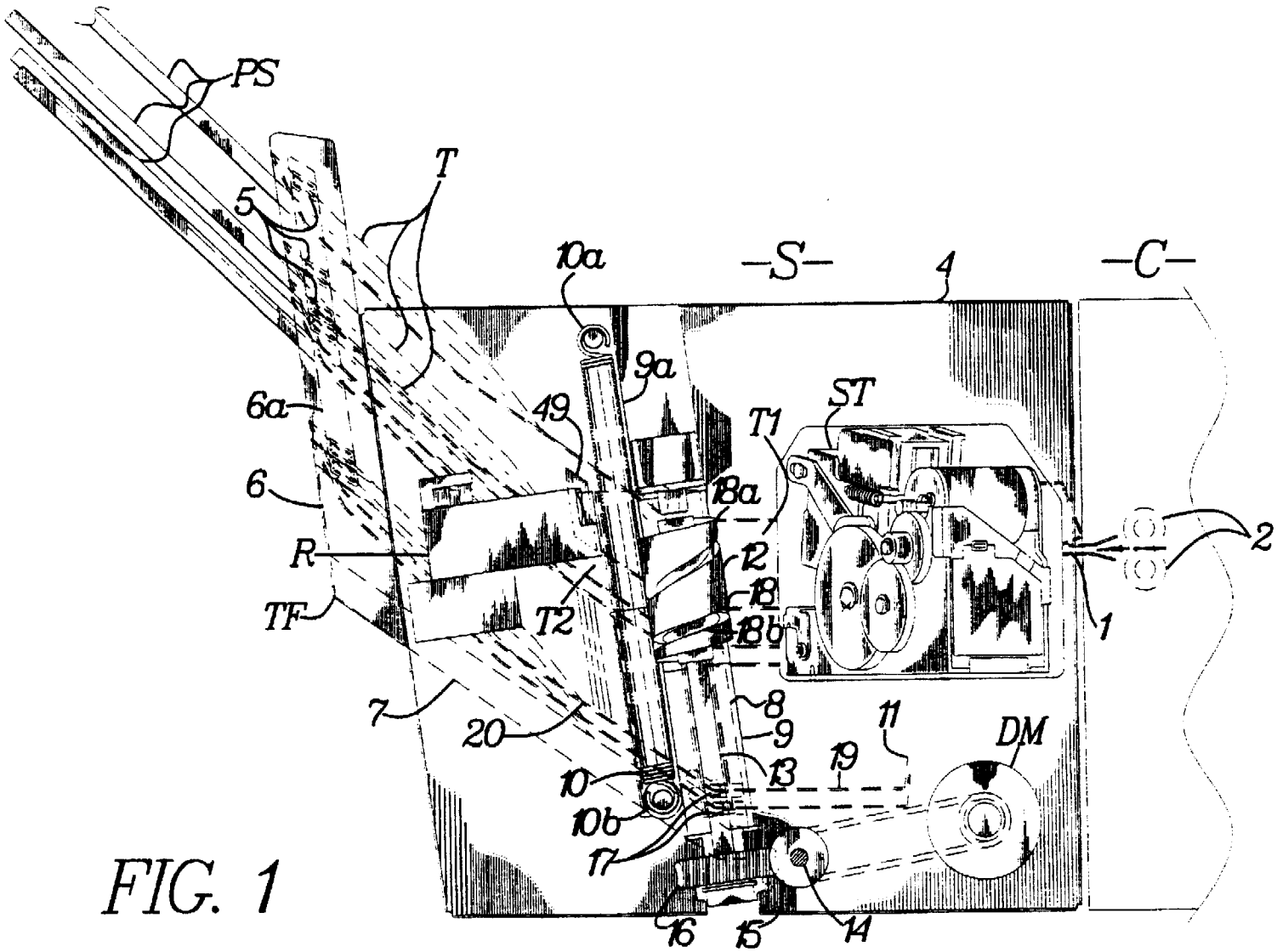
FIG. 1 is a side elevational view showing a moving bin sorter incorporating the invention.

As seen in the drawings, a sorter construction is illustrated which is more particularly the subject of the above referenced companion application.

Figure 2:
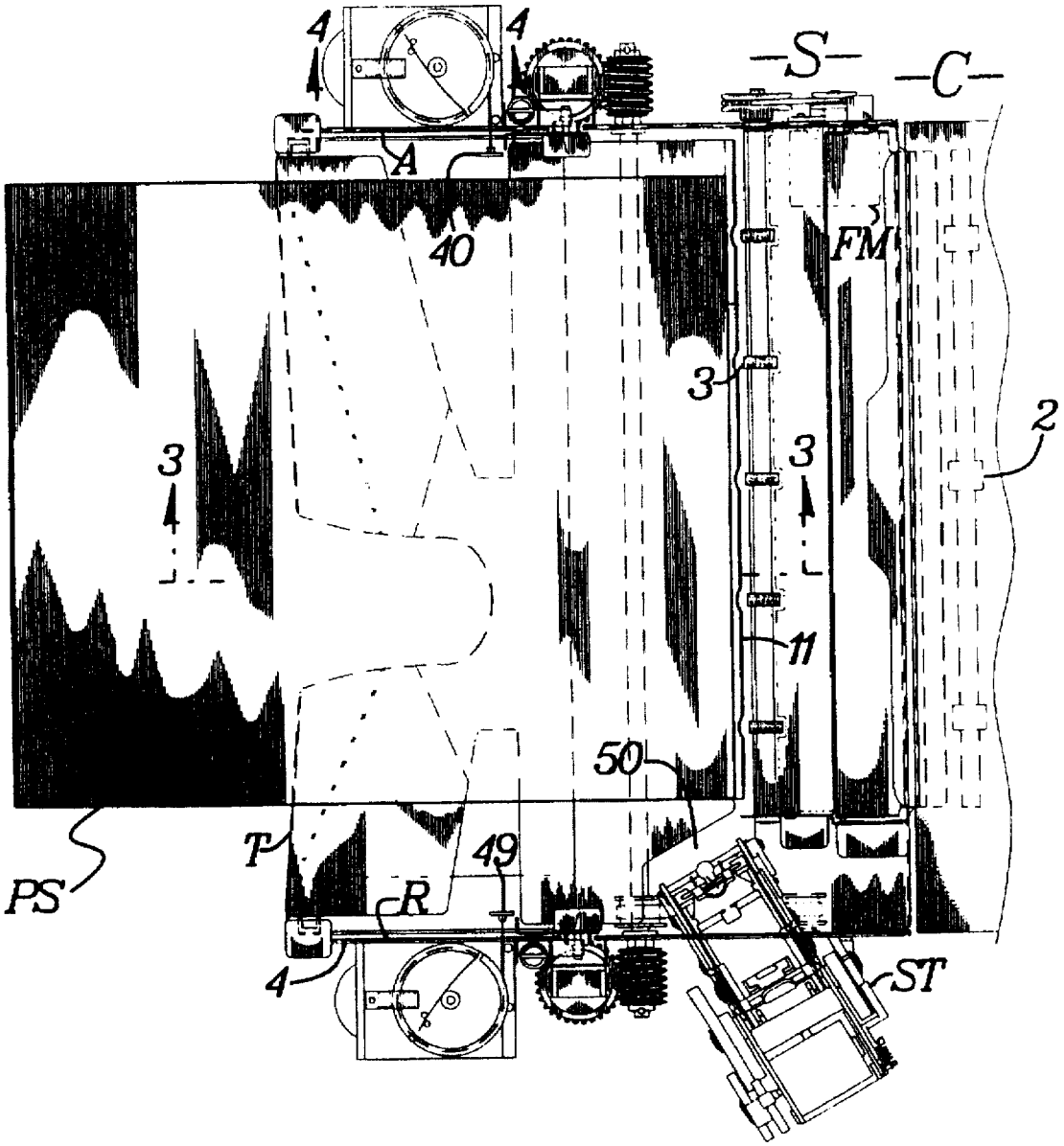
FIG. 2 is a top plan view.
Figure 3:
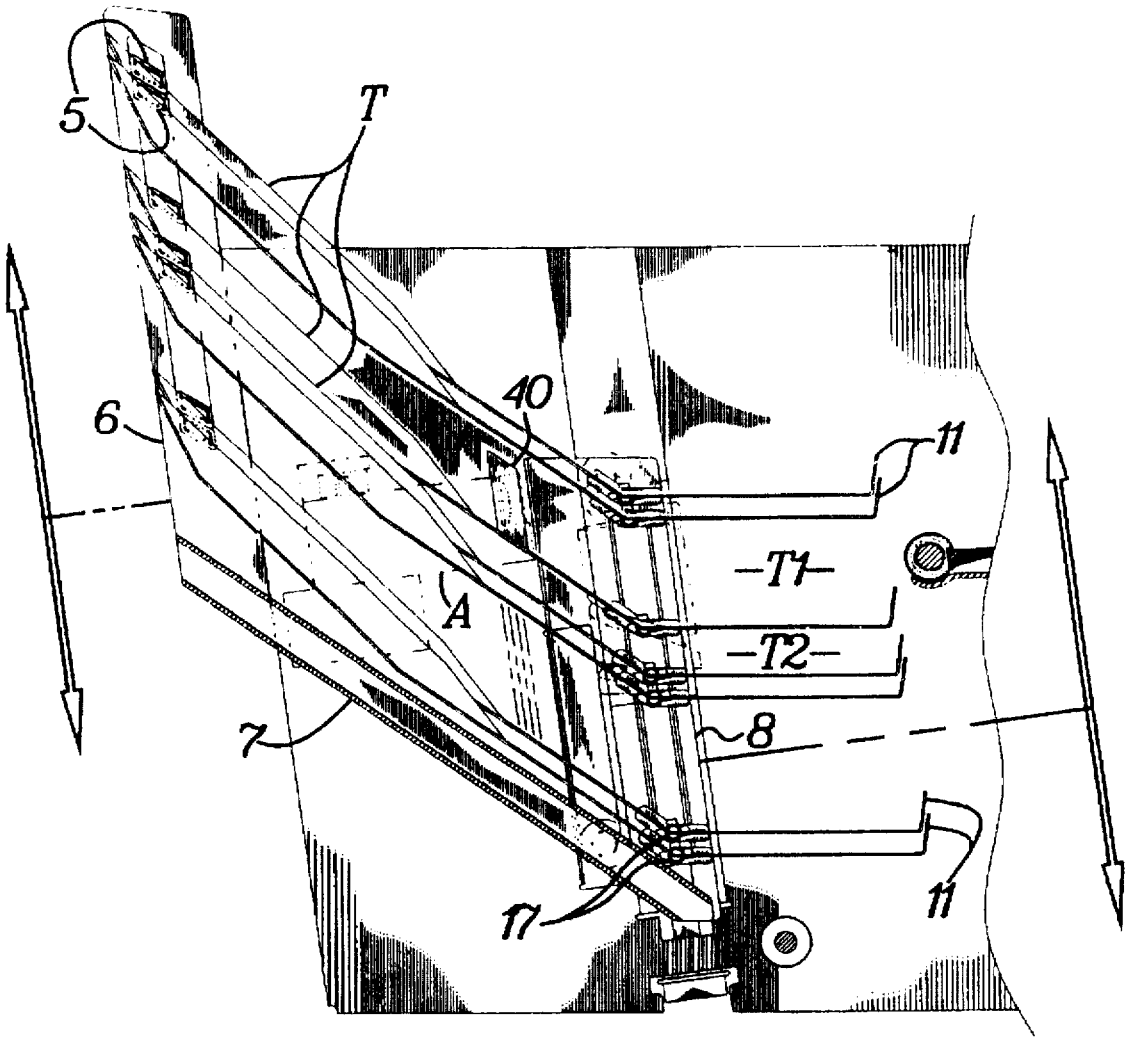
FIG. 3 is a fragmentary vertical section on the line 3—3 of FIG. 2 showing the operation of the sorter.

Referring first to FIGS. 1 and 2, a sheet receiving or sorting machine S is associated with a copier or printer C and is adapted to receive sheets from a copier or printer through a sheet path 1 from the output rolls 2 of the host machine. Infeed roll means 3 is driven by suitable feed motor enclosed within the sorter housing 4.

Also within the sorter housing or main frame 4 is a tray support structure or tray frame TF in which a set of sorter trays T are mounted, the trays extending horizontally end upwardly from the infeed 3 to receive printed sheets PS fed into the trays from the host machine C. The trays T have outer ends 5 supported for vertical sliding movement in a pair of upwardly extended outer tray end support or guide members 6 disposed at opposite sides of the trays. The members 6 are joined with a lower tray support plate 7 and extend upwardly at opposite sides of the trays for vertical movement relative to the sorter main frame or body structure 4.

At the lower end of the tray support 7, at opposite sides of the trays within the housing 4, is a pair of tray frame members or side plates 8 vertically shiftably mounted in opposing vertical slots or channels 9 in housing 4 and extending upwardly in substantial parallel relation with the outer tray end support members 6. A side wall 9*a* of the slots or channels provides a sliding bearing surface for side plates 8, which may be, if desired, provided with suitable anti-friction bearings.

A pair of coiled tension springs 10 are interconnected at their upper ends 10*a* with the side walls of the housing 4, and at their lower ends 10*b* with the bottom tray support 7 or side plates 8, whereby to apply an upward bias to the support frame TF and the trays supported therein.

Means are provided for mechanically shifting the trays T upwardly and downwardly so a to provide a large entry space T1 for receipt of sheets entering the sorter from the infeed 3 and for moving the trays between positions closely spaced together above and below the enlarged sheet entry space T1 and resting on or engaged with one another at their sheet inlet ends and their outer ends. As here shown, the tray shifting means comprise a pair of rotary spiral cams 12 mounted upon drive shafts 13 and adapted to be rotated in opposite directions by a drive motor DM through a cross shaft 14, worms 15 and worm gears 16 on the respective shafts 13.

Cam followers 17 including trunnions engageable in a spiral cam track 18 in the respective cams 12 and mounted at opposite sides of the trays at the junction between the inner horizontal tray sections 19 and the upwardly inclined sections 20, are adapted to cause upward and downward movement of the inner ends of the trays responsive to rotational movement of cams 12 in opposite directions. Cam track 18 has an upper high pitch track 18*a* and a low pitch track 18*b* which cooperate with the trunnions 17 to form enlarged sheet receiving space T1 and the subjacent increased but smaller space T2 for purposes which will be hereinafter described.

Downward engagement of the cam followers 17 with the top of the cams and in cam track 18, in one direction of rotation, is caused by the weight of the trays, plus any paper sheets in the trays resting one on the other above the cams. On the other hand, upward engagement of the trunnions 17 by the cam track 18, upon rotation of the cams in the other direction, is in response to the upward bias of the springs 10 which urge the trays upwardly by virtue of connection of the springs to frame structure TF, in an upward direction into engagement with the lower ends of cams 12.

In the form of the trays shown herein, the trays are configured like those disclosed in the pending application of Coombs Ser. No. 546,848, filed Oct. 23, 1995, so as to have an extension in the horizontal direction which is quite short, as compared with typical trays, as shown in the prior art cited at the commencement hereof.

The trays T are moved vertically relative to one another in the slot 6*a* and slot or channel 9 of tray frame members 6 and 4 to form the enlarged sheet entry space T1. However, during all movements of the trays, the trays move together and are retained in their substantial parallel relation by the interaction between the cams 12, the outer tray ends 5 with tray support member 6 and the trunnions 17 with the frame or tray side plate members 8, as the trays above the cams 12 move upwardly, upon engagement of successive trays with the trays thereabove, while the coiled springs 10 move the tray frame structure upwardly to maintain the uppermost tray located below the cams in engagement with the bottom of the cams, and as the trays above the cams move downwardly by gravity, the trays below the cams are moved downwardly against the bias of the springs, as successive trays are moved downwardly by the cams.

The construction is such that the tray end 5 is able to vertically slide in either direction within the slot 6*a* to enable the trays to be separated by the cams 12 to form the enlarged space T1, but the tray ends 5 will always travel in a parallel relation, and any downward tilting of the trays about the trunnions 17 is prohibited by the locking action of the tray tips 5 in the slots 6*a*, as more fuly illustrated and described in the above referenced companion application, commonly owned herewith and to which reference may be made.

As indicated above, the outer end support 6 also moves vertically as a result of the bottom support 7 being connected to the tray side plates 8 which are vertically movable in the slot or channel 9 in the housing construction in parallel relation to the slot 6*a*. Trunnion members 17 which are located below the cams 12 are biased upwardly towards the cams, as shown, by the coil springs 10 acting upwardly on the bottom frame member 7, and the trunnion members 17 are also free to relatively shift vertically as the trunnion engages in the cam profile 18 so as to cause the trays to shift relatively vertically and form the enlarged sheet receiving space T1 above and below which the trays T are parallel.

In accordance with the present invention, as best seen in FIG. 2 and 5*a* through 5*d*, means A are provided for aligning sheets entering the enlarged sheet entry space T1 by moving the sheets lateraly of the direction of sheet infeed and into engagement with registration means R.

Figures 5A, 5B, 5C, 5D:
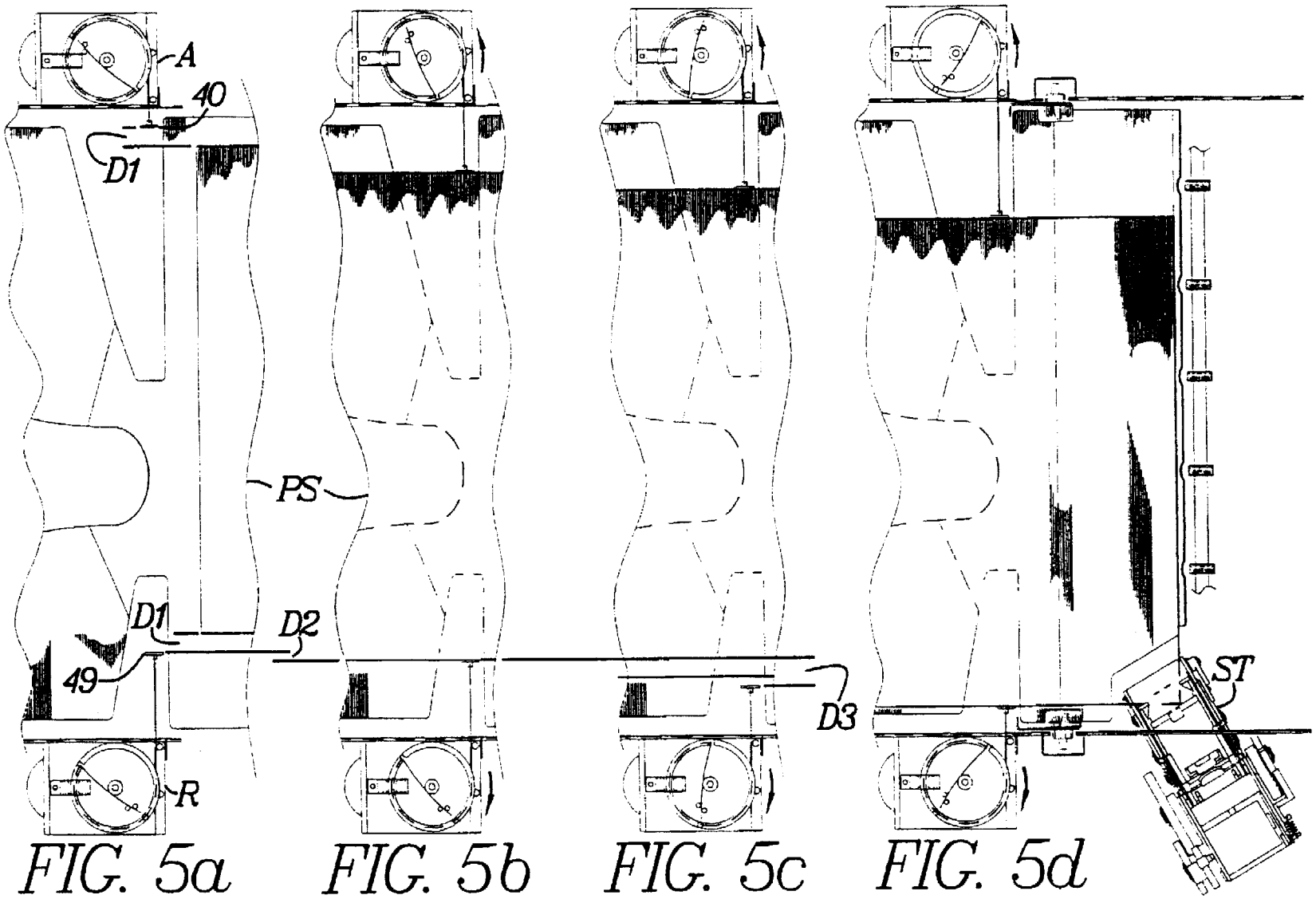
FIGS. 5*a* through 5*d* are sequential fragmentary horizontal sections showing the aligning and registering functions as the sheet sets are laterally moved during the aligning and stapling operations.

Alignment of the edges of sheets of different sizes is important for providing neat sets, but especially when the sets of sheets are to be automatically stapled by a stapler ST, as seen in FIGS. 1, 2 and 5*d*. The stapler may be of any type adapted for automatic stapling in in-tray stapling sorters.

In this case, the stapler is supported by the sorter frame in a stationary position, disposed at an angle to the side of the sheet set with the stapler throat opening in an angular space 50 at one of the inner end corners of the trays.

Referring to FIG. 2, in particular, it will be seen that the aligner means A and the registration means R are appropriately supported on the frame structure at opposite sides of the apparatus. Preferably the two devices are identical but turned in reverse so as to provide an aligner pad 40 and a registration pad 49 which are opposed to one another at opposite sides of the trays with flat opposing, parallel faces disposed at a right angle to inner end wall 11 of the trays. As will be later described, these pads 40 and 49 are adapted to be moved relatively in opposite directions so that the aligner pad 40 engages one side edge of the sheet and the registration pad 49 engages the opposite side of a sheet so that the side edges are aligned between the pads. Each of the pads 40 and 49 is of limited vertical height so that upon movement of the respective pads towards one another, the pads will be accommodated in the enlarged sheet entry space T1 so as to engage only the edges of sheets in the space T1.

The additional space T2 below the space T1, which is greater than the normal space between the trays in their upper and lower positions is provided to assure that in the event of edge deformation or curling of the sheet the side edge of the sheet cannot curl upwardly into the space T1, thereby causing interference.

Figure 4:
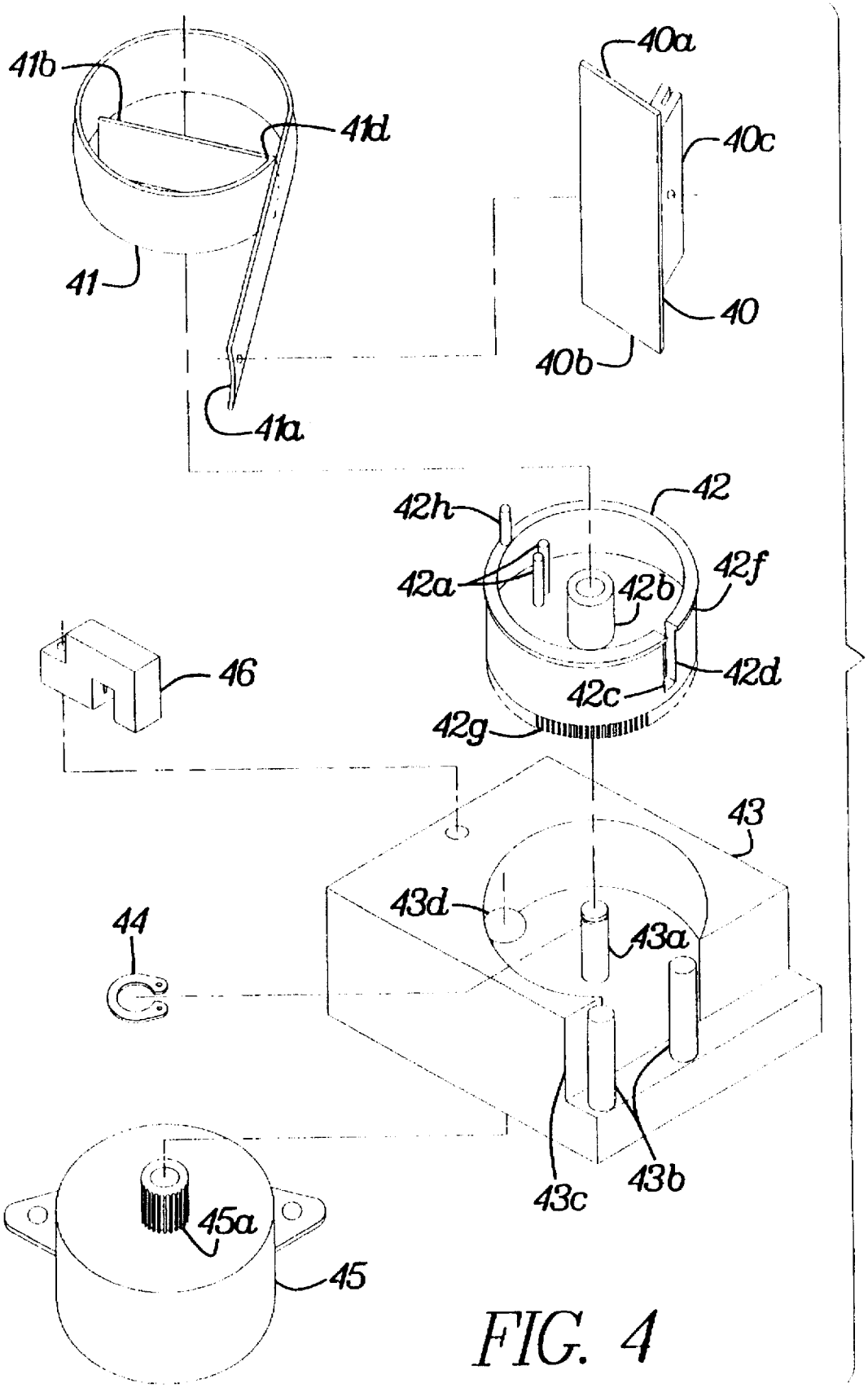
FIG. 4 is an exploded perspective of the components comprising an alignment or registration device.

A representative, one of the pair of similar alignment and registration means A & R is illustrated in FIG. 4.

Aligner pad 40 has upper and lower edges 40*a* and 40*b* disposed at an incline corresponding with the incline of the parallel spaced trays forming tray T1 and supporting flange 40*c* is formed on the pad for connection with a resiliently flexible tempered steel member 41 which is like the typical steel measuring rules and is formed so as to be concave, as indicated at 41*a*, to flexibly resist bending under the small forces applied during utilization of the device. At the opposite end of the steel rule member 41 from the pad 40, it is formed with angularly extended section 41*b* enabling reception of the rule in a cylindrical spool 42 with portion 41*b* extending between a pair of vertical pins 42*a* at one side of a central post 42*b* and through a peripheral vertical slot 42*c* having a vertical side 42*d* to receive the rule section 41*b* at the point of connection of this portion to an elongated section of the rule which is would about the exterior of the spool 42 and held thereabout by an upper flange 42*f*. At the base of a spool 42 is an annular gear 42*g*.

A housing 43 for the spool and the flexible rule has a cylindrical recess into which the spool can be inserted about a central post 43*a* extending upwardly through the hollow post 42*b*, with a straight section of the rule extending through the spool slot 42*c* and between a vertical guide wall 43*c* which may be arched to conform with the shape of the rule and a pair of opposing retainer pins 43*b*.

The spool 42 and housing 43 are simply held in assembly, as by snap ring 44 so that the rule is readily extensible and retractable from the housing in response to rotation of the spool.

Rotation of the spool 42 is caused by a suitable stepper motor 45 having on its drive shaft a pinion gear 45*a* which is adapted to be extended upwardly through a hole 43*d* in the bottom of housing 43 into engagement with the annular gear 42*g*.

A photosensor 46 is associated with the assembly and is adapted to position the spool 42 within a housing 43 at a normal or so-called home position upon positioning of a pin 42*h* at the photosensor. This enables the steps or pulses applied to the motor 45 to determine the degrees of displacement of the spool 42 and therefore, the lateral movement of aligning pad 40 with respect to the trays T and the printed sheets therein.

It would be recognized that since the registration means R is identical to but reversed from the alignment means A, similar control of a similar registration motor is provided and that the alignment motor and the registration motor in concert can be controlled in the usual manner to cause movement of the pads 40 and 49 towards and away from one another for engagement with the sheets in the sheet receiving space T1 of various lateral dimensions or sheet sizes. The ability of the respective pads 40 and 49 to be laterally extended in a controlled manner also enables the sets of sheets in space T1 of different sizes to be aligned, moved to a stapling position, as well as to be returned to the appropriate position on the tray for subsequent removal.

Referring to FIGS. 5*a* through 5*d*, the aligner pad 40 and the registration pad 49 are staged a desired distance D1 from incoming printed sheet PS, the distance allowing for tolerances of sheet feeding and sheet size. The host machine may inform the sorter of the paper size or width in the direction of sheet feed into the tray space T1, in order to locate both pads correctly.

After the printed sheet has been received and settled against the inner tray ends 11, as seen in FIG. 2, the registration mechanism am shown in FIG. 5*b* extends its pad 49 to a set position where all sheets of all sets of all trays, as the trays are moved vertically to provide space T1 and T2 between successive trays, will be registered as shown by D2. The aligner mechanism then extends its pad 40 to force the printed sheet in compliant engagement with the registration pad 49. The stepping mechanism of the aligner can be accelerated prior to sheet contact with pad 40 and then de-accelerated as the sheet is touched in order to establish a gentle action of pad versus sheet, as is well known.

During compliant engagement, the pads 40, 49 may be held in contact with the printed sheet for a short time to insure all movement of the sheet has stopped, and pad 40 may be retracted slowly so as to not disturb the sheet or cause "spring-back" of the sheet from pad 49. When pad 40 is not in contact with the sheet, then the pad may be accelerated back to its staging position awaiting the next sheet in the next tray. Meanwhile the registration pad is also returned to its original staged position awaiting the next sheet or tray transfer. It is apparent from this sequence of events that each sheet may be aligned as it is received in space T1 although the sequence could be modified so as to align every other received sheet.

After the aligning process has been completed for all sheets received, and if stapling is selected for these particular sets, FIG. 5*c* shows the printed sheets being partially advanced toward the stapler. This is accomplished by the registration pad being retracted from the sheets slightly, as shown by D3, just prior to the aligner pad forcing the sheets forward. The registration pad and the aligner then in unison move the set toward the stapler in aligned condition.

FIG. 5*d* shows the registration pad stopped in the location within the stapler throat in the correct location for insertion of a stapler into the sheet set.

The aligner pad forces the printed sheets into compliance once again and holds them while the stapler is driven into the sheets forming a finished set. In this case with the aligner rule almost fully extended, then the compliance action is also aided by the 41*d* portion of the rule riding against the 42*d* surface of the drum. This action allows a more gentle compliance between the paper and the registration rule.

Following stapling of the set the aligner pad is retracted slightly and the registration pad is extended, in unison. This action continues until the stapled set has been returned to the prescribed registration area shown in 5*b*, or to some other prescribed location.

The pads are then returned to the staged area shown in 5*a* while the trays are moved to provide another enlarged space T1 and a new unstapled set is available for aligning, registering, stapling and return.

This sequence will continue until all printed sheets are stapled sets.

As indicated above, increased space T2 allows space for settling of sheet in the set below space T1 and reduces the likelihood of curled paper edges being engaged with the pads 40 and 49 which are approximately the height of space T1. However, in addition, in the event that the stapler is adapted for movement say to stitch sheets with staples along one edge, then increased space T2 provides space below the lower tray forming space T1 for access below the sheets for the anvil of the stapler, as is known from U.S. Pat. No. 4,687,191, issued Aug. 18, 1987 to Stemmle.

We claim:

1. In a sheet sorting machine of the type including a housing, a set of trays which are arranged in vertically spaced, horizontally extended inclined relation and are vertically movable between closely spaced positions located above and below a sheet entry location forming an inclined and enlarged sheet entry space, including rotary cam means for moving the trays between said positions and forming said enlarged sheet entry space when stationary, cam followers at opposite sides of said trays engageable with said cam means, and aligning and registering means for engagement with the side edges of sheets in said trays, the improvement wherein said aligning and registering means is operable for aligning sets of sheets between the trays forming said sheet entry space and includes a pair of aligning and registering pads, means extensible and retractable in said sheet entry space for moving said pads towards and away from one another, said pads being shaped to conform with the enlarged and inclined space between the trays forming said sheet entry space.

2. In a sheet sorting machine as defined in claim 1, said pads having flat sheet engaging faces disposed in opposing parallel relation.

3. In a sheet sorting machine as defined in claim 1, including extensible and retractable flexible members supporting said pads for relative movement and drive means for extending and retracting said flexible members.

4. In a sheet sorting machine as defined in claim 1, including flexible members in the form of steel rules supporting said pads for relative movement.

5. In a sheet sorting machine as defined in claim 1, including stapling means disposed at a side of the trays providing said sheet entry space, said aligning and registration means being operable to move sets of sheets therebetween into stapling position in said stapling means.

6. In a sheet sorting machine as defined in claim 1, including stapling means disposed at a side of the trays providing sheet entry space, said aligning and registration means being operable to move sets of sheets therebetween into stapling position in said stapling means, said stapling means being located in a fixed position in one corner of said sheet entry space.

7. In a sheet sorting machine as defined in claim 1, including stapling means disposed at a side of the trays providing sheet entry space, said aligning and registration means being operable to move sets of sheets therebetween into stapling position in said stapling means, said stapling means being located in a fixed position in one corner of said sheet entry space, said aligning and registration means returning said set of sheets from said stapling means to another position between said trays forming said sheet entry space.

8. In a sheet sorting machine as defined in claim 1, including vertically movable support means for the inner and outer ends of said trays supporting said trays for vertical movement in parallel relation in both said closely spaced position and said enlarged sheet entry space position.

* * * * *